US005283153A

United States Patent [19]

Sacripante et al.

[11] Patent Number: 5,283,153

[45] Date of Patent: Feb. 1, 1994

[54] ENCAPSULATED TONER PROCESSES

[75] Inventors: Guerino G. Sacripante, Oakville; Grazyna E. Kmiecik-Lawrynowicz; Hock S. Tan, both of Burlington; Raj D. Patel, Oakville, all of Canada

[73] Assignee: Xerox Corporation, Stamford, Conn.

[21] Appl. No.: 868,745

[22] Filed: Apr. 15, 1992

[51] Int. Cl.[5] ..... G03G 9/093

[52] U.S. Cl. ..... 430/138

[58] Field of Search ..... 430/109, 107, 138

[56] References Cited

U.S. PATENT DOCUMENTS

| | | | |
|---|---|---|---|
| 4,465,756 | 8/1984 | Mikami et al. | 430/138 |
| 4,626,490 | 12/1986 | Yamazaki et al. | 430/138 |
| 4,727,011 | 2/1988 | Mahabadi et al. | 430/138 |
| 4,797,339 | 1/1989 | Maruyama et al. | 430/109 |
| 4,816,366 | 3/1989 | Hyosu et al. | 430/137 |
| 4,937,167 | 6/1990 | Moffat et al. | 430/137 |
| 4,996,127 | 2/1991 | Hasegawa et al. | 430/109 |
| 5,043,240 | 8/1991 | Ong et al. | 430/109 |
| 5,139,915 | 8/1992 | Moffat et al. | 430/138 |
| 5,175,071 | 12/1992 | Mychajlowskij | 430/138 |

*Primary Examiner*—John L. Goodrow

*Attorney, Agent, or Firm*—E. O. Palazzo

[57] ABSTRACT

A process for the preparation of encapsulated toner compositions which comprises dispersing a mixture of addition monomers, an optional preformed polymer resin, a free radical initiator, a colorant comprised of a pigment, dye or mixtures thereof, and shell forming monomer in an aqueous medium containing a cellulose polymer and a first ionic surfactant thereby forming a stable microdroplet suspension; and subsequently adding an aqueous solution of a second stabilizing surfactant followed by the formation of a soluble monomer forming shell wall by interfacial polymerization, and thereafter initiating and completing the core resin-forming free radical polymerization by heating thereby resulting in toner compositions with an average volume particle size of from about 3 to about 7 microns.

22 Claims, No Drawings

ENCAPSULATED TONER PROCESSES

BACKGROUND OF THE INVENTION

The present invention is generally directed to toner compositions and processes thereof, and more specifically, the present invention relates to colored encapsulated toner compositions and processes thereof, and wherein these toners can be directly generated without resorting to the conventional pulverization and classification methods. In one embodiment, the present invention relates to processes for the preparation of colored encapsulated toner compositions comprised of a core comprised of a polymer resin and colorants, including color pigments, dyes, or mixtures thereof, and coated thereover a polymeric shell like a polyurethane shell material. In one embodiment, the present invention relates to processes for preparing encapsulated toners, which process comprises dispersing a mixture of free radical monomer, colorant, or pigment, optionally a charge control agent and containing a shell forming monomer such as dodecane diisocyanate, trimethylhexamethylene diisocyanate and the like in an aqueous medium containing a cellulose surfactant, such as hydroxyethylmethyl cellulose (TYLOSE ®), methyl cellulose and the like; and a dispersant such as sodium dodecylsulfate to control the volume average particle size of from about 3 to about 7 microns in diameter; and adding subsequently a second polymeric stabilizing surfactant, such as polyvinyl alcohol; followed by the addition of a second shell forming monomer, such as an amino terminated propylene glycol (JEFFAMINE D-400 TM available from Texaco), yielding by polymerization a polyurethane shell; and accomplishing core resin formation step by free radical polymerization. In another embodiment, the present invention relates to a process of preparing colored encapsulated toner of fine particle size of from about 0.5 micron to about 7 microns in diameter and more preferably from about 2 microns to about 7 microns in diameter, as measured by the Coulter Counter. In another embodiment, the present invention relates to colored encapsulated toner compositions which display low fixing temperatures of from about 100° C. to about 120° C., thereby reducing the energy consumption of an electrostagraphic imaging or printing apparatus and prolonging the lifetime of the fuser contained therein. Furthermore, in another embodiment, the present invention relates to a colored encapsulated toner composition and process of generating a polyurethane material surrounding a core material, and wherein the polyurethane material has a softening point of from about 80° C. to about 110° C. as measured by the Shimadzu Flowtester. Additionally, in another embodiment, the present invention relates to colored encapsulated toners which display high projection efficiency of from about 60 percent to about 95 percent transparency as measured by the Match Scan II spectrophotometer available from Milton Roy Corporation. In embodiments, the processes of the present invention can also utilize a combination of cellulose polymers of from about 0.1 percent to about 5 percent by weight of toner, and ionic or inorganic surfactants of from about 0.01 percent to about 0.5 percent by weight of toner, such as potassium oleate, sodium dodecyl sulfate, and the like during the dispersion step. The cellulose-ionic and alkali surfactant system facilitates efficient generation of very small sized microdroplets, particularly those with an average particle diameter of from about 0.5 micron to about 7 microns, together with a narrow particle size distribution of less than 1.35, as measured by the Coulter Counter. The main function of the second surfactant, such as polyvinyl alcohol, selected in effective amounts of, for example, from about 0.1 to about 2 percent by weight of the aqueous fraction and preferably from about 0.5 to about 1 percent by weight of the aqueous portion is to stabilize the microdroplet size such that when the subsequent addition of diamine, such as JEFFAMINE D-400 TM, is employed to form the polyurethane shell, particle coalescence, particle growth or aggregation does not occur, or is minimized.

The primary function of the polyurethane shell of the colored encapsulated toner of the present invention is to provide for the mechanical integrity of toner, minimizing or eliminating the seepage of the inner core material, hence preventing undesired toner aggregation or coalescence. Additionally, another function of the polyurethane shell of the colored encapsulated toner of the present invention, such as that obtained when dodecane diisocyanate and JEFFAMINE D-400 TM are utilized, is to provide a softening point of from about 80° C. to about 120° C., such that when the aforementioned encapsulated toner is fixed on paper, by the utilization of a hot-roll fusing device, the polyurethane shell melts, deforms or fixes on paper and provides excellent adherence to paper at low minimum fixing temperatures of from about 100° C. to about 120° C., and provides a smooth surface such that when fixed on transparency sheets, results in high projection efficiency.

In color reprography, such as in full color or highlight color applications, colored toners with a wide variety of colors including black are usually employed. In color reprography, a heat-assisted transfix step or heat-roll fusing is applied to the toner image on paper. It is highly desirable to use VITON ® fuser rollers rather than the conventional silicone roll fusers due to the drastically prolonged lifetime attained by a fuser roll containing VITON ® surfaces. During the fixing step employing heated Viton roll fusers, the toner is fixed on paper or transparency, and the energy necessary to achieve this is related to the temperature applied by the rolls. Accordingly, toners which fix on paper with a minimum amount of heat are highly desirable. The temperature necessary to properly fix a particular toner onto paper is known as the minimum fixing temperature (MFT). It is known that encapsulated toner compositions are highly desirable for low minimum fixing applications, such as from about 110° C. to about 150° C., and preferably from about 110° C. to about 130° C. The aforementioned encapsulated colored toners are comprised of a core resin with low glass transition temperature resin enabling, for example, excellent fixing of the toner onto paper at the aforementioned low minimum fixing temperatures. Also, the core is surrounded by a shell material avoiding or minimizing core aggregation or agglomerate during storage or until use. Encapsulated toner fusing onto paper is accomplished by the rupturing of the shell component, release of the sticky inner core resin and its penetration into the paper fiber, and sticking or adherence of the resin onto the paper with colorants, dyes and additives. The primary function of many of the prior art encapsulated toners containing polyurethane shell was for containment of the sticky core resin to avoid toner aggregation. Toner aggregation can result in a dramatic increase of toner particle size, and when transferred electrostatically to paper by various imaging methods results in broad images or undesired low resolution. Accordingly, many prior art encapsulated toners which utilize polyurethane shells rupture during the fixing step and do not melt or adhere to paper, but permit the core binder resin to be released and to fix and adhere onto the paper and to stick or adhere to the ruptured polyurethane component. The aforementioned ruptured shell results in an uneven or bumpy surface texture especially when fused on a transparency causing low projection due to the scattering of light on the toner surface. In color reprography, it is highly desirable to generate process color images on a transparency, which can be used on overhead projectors to project bright colors on wall screens. The quality of the color projection or the percent of transmittance of light through the toner image on the transparency depends on several factors such as acceptable toner pigment dispersion, similar refractive index of shell and core resin, and the surface texture of the toner image whereby surface scattering of light is minimized or eliminated. It is known that bumpy surface texture of toner images on a transparency results in undesired light scattering, hence a low projection efficiency of less than 60 percent transmittance can occur. The encapsulated toners of the present invention in embodiments contains a shell such as a polyurethane shell which is heat fusible, hence melts and softens during the fixing step and is sticky providing excellent adherence to paper or transparency with the core resins such that low minimum fixing temperatures of from about 100° C. to about 120° C. are obtained, thus greatly reducing the energy requirements of the fuser and prolonging its lifetime. Furthermore, the ability of the shell material to soften or melt provides a smooth toner surface and results in low surface scattering, hence a high projection efficiency of from about 60 percent to about 95 percent transmittance as measured by the Match Scan II. Furthermore, the colored encapsulated toners of this invention are of fine average volume particle sizes of from about 0.5 micron to about 7 microns and more preferably from about 2 microns to about 7 microns in diameter. The process for preparing encapsulated colored toners of this invention with average particle sizes of from about 0.5 micron to about 7 microns, utilizes a second surfactant, such as polyvinyl alcohol, which stabilizes the microdroplet and prevents it from coalescing or aggregating during the polyurethane shell forming state. In prior art encapsulated toner processes, a second surfactant to stabilize the microdroplet is not utilized and average particle sizes of from about 0.5 micron to about 7 microns cannot be readily attained, rather average particle sizes of from about 11 microns to about 19 microns are, for example, disclosed. Additionally, the encapsulated toner compositions of the present invention display excellent tribo characteristics such that the triboelectric properties of different colored toners be desirably controlled thus they all can attain similar equilibrium triboelectric charging levels when utilized against a selected carrier. This is especially useful for custom colored toner packages since colored toners with a wide variety of custom colors can be obtained by simple blending of the primary colored toners. Another important aspect for two component development is the rate of charging of the fresh toners to the equilibrium charge levels when they are added to the toner depleted development housing. A fast rate of charging of fresh toner can be important in ensuring proper image development, particularly for high speed, greater than 70 copies per minute for example, reprographic systems.

There was reported in a patentability search relating to encapsulated toners the following prior art: U.S. Pat. No. 5,043,240, the disclosure of which is totally incorporated herein by reference, illustrates a pressure fixable encapsulated toner comprised of a core, and an encapsulating substance comprised of a pressure rupturable shell, wherein the shell is formed by an interfacial polymerization, such as a polyurethane shell, and processes thereof wherein a surfactant stabilizing step prior to the shell formation is not utilized and particle sizes of 13 microns to about 21 microns are reported, however, the process of this '240 patent does not, it is believed, yield toner particles of less than 7 microns, reference Comparative Examples I and II. Furthermore, the polyurethane shell of the aforementioned '240 patent is believed to rupture and may not melt readily resulting in an uneven surface, and hence, display low projection efficieny. The process of the present invention contains a second stabilizer step before formation of the shell resin in order to provide particle stabilization and thus providing small particle sizes of less than or equal to 7 microns in diameter. The utilization of a second surfactant is important in generating small particle size encapsulated toners of less than or equal to 7 microns. Additionally, the polyurethane shell is pressure rupturable and heat fusible, and the monomer components of the polyurethane shells invention include diamino-ethers, such as JEFFAMINE D-400 TM, JEFFAMINE D-700 TM, and the like to enable low softening points of from about 80° C. to about 120° C. such that during the fixing step the polyurethane shell melts, adheres to paper or transparency and provides a smooth toner surface, and hence, high projection efficiency. Other prior art toner patents include U.S. Pat. No. 3,967,962 which discloses a toner composition comprising a finely divided mixture comprising a colorant material and a polymeric material which is a block or graft copolymer, including apparently copolymers of polyurethane and a polyether (column 6), reference for example the Abstract of the Disclosure, and also note the disclosure in columns 2 and 3,6 and 7, particularly lines 13 and 35; however, it does not appear that encapsulated toners are disclosed in this patent; U.S. Pat. No. 4,626,490 discloses an encapsulated toner comprising a binder of a mixture of a long chain organic compound and an ester of a higher alcohol and a higher carboxylic acid encapsulated within a thin shell, reference the Abstract of the Disclosure, for example, and note specifically examples of shell materials in column 8, beginning at line 64, and continuing on to column 9, line 17, which shells can be comprised, for example, of polyurethanes, polyurea, epoxy resin, polyether resins such as polyphenylene oxide or thioether resin, or mixtures thereof; 4,937,167 relating to encapsulated toners with a diameter of less than 10 microns; and U.S. patents of background interest include U.S. Pat. Nos. 4,442,194; 4,465,755; 4,520,091; 4,590,142; 4,610,945; 4,642,281; 4,740,443 and 4,803,144.

Interfacial polymerization processes are described in British Patent Publication 1,371,179, the disclosure of which is totally incorporated herein by reference, which publication illustrates a method of microencapsulation based on in situ interfacial condensation polymerization. Moreover, there are disclosed in U.S. Pat. No. 4,407,922, the disclosure of which is totally incorporated herein by reference, interfacial polymerization processes for pressure sensitive toner compositions comprised of a blend of two immiscible polymers selected from the group consisting of certain polymers as a hard component, and polyoctadecylvinylether-co-maleic anhydride as a soft component.

Other prior art includes U.S. Pat. No. 4,520,091, the disclosure of which is totally incorporated herein by reference, which illustrates an encapsulated toner material wherein the shell can be formed by reacting a compound having an isocyanate with a polyamide, reference column 4, lines 30 to 61, and column 5, line 19; and U.S. Pat. No. 3,900,669 illustrating a pressure sensitive recording sheet comprising a microcapsule with polyurea walls, and wherein polymethylene polyphenyl isocyanate can be reacted with a polyamide to produce the shell, see column 4, line 34.

Illustrated in U.S. Pat. No. 4,758,506 (D/84024), the disclosure of which is totally incorporated herein by reference, are single component cold pressure fixable toner compositions, wherein the shell selected can be prepared by an interfacial polymerization process.

There is a need for colored encapsulated toners which display low minimum fusing temperatures of from about 100° C. to about 120° C., wide fusing latitude, can be formed in fine particle sizes such as from about 0.5 to 7 microns, have nonblocking tendencies, and with heat-fusible polyurethane shells with softening points of from about 80° C. to about 120° C., of high projection efficiency on a transparency such as from about 60 to about 95 percent transmittance, and of stable triboelectricity properties including substantially complete passivation. These and other needs are accomplished with the colored encapsulated toners and process thereof of the present invention. More specifically, thus with the toners of the present invention, the toner properties can in many instances be tailored to certain specifications. Additionally, complete or substantial passivation of the triboelectric charging effects of the colorants is accomplished, and smaller toner particle sizes of from about 2 microns to about 7 microns with narrow size distribution can be achieved without conventional classification techniques. Also, the toners of the present invention do not block or agglomerate over an extended period of time, for example up to six months, in embodiments.

SUMMARY OF THE INVENTION

It is an object of the present invention to provide processes for toner compositions with many of the advantages illustrated herein.

Additionally, it is an object of the present invention to provide processes for the formation of toners with desirable properties such as excellent toner powder flow, and nonblocking characteristics, excellent color fidelity, resistance to vinyl offset, and excellent image permanence characteristics.

Further, in another object of the present invention, there are provided processes for color toners which exhibit similar equilibrium triboelectric properties against a selected carrier irrespective of the colorants present.

A still further related object of the present invention is to provide colored toners and processes thereof which possess rapid rates of triboelectric charging when admixed with carrier particles.

Moreover, another object of the present invention is the provision of processes for colored toners exhibiting low temperature fusing properties.

A further object of the present invention is to provide a simple process for the generation of small sized black and colored toners with narrow size distribution without the need to resort to conventional pulverization and classification techniques.

In a further object of the present invention there are provided preparative processes for directly generating toner compositions comprised of a polymer resin or resins and colorants, encapsulated by polyurethane shell, and wherein the minimum fixing temperature of the toner is from about 100° to about 120° C.

In another further object of the present invention there are provided preparative processes for directly generating toner compositions comprised of a polymer resin or resins and colorants, encapsulated by polyurethane shell, and wherein the projection efficiency of the toner image after fixing on transparency is from about 60 to about 95 percent transmittance.

In a still further object of the present invention there are provided preparative processes for directly generating toner compositions comprised of a polymer resin or resins and colorants, encapsulated by polyurethane shell, and wherein the average particle size of the toner is from about 3 to about 7 microns.

Also, in another object of the present invention there are provided preparative processes by dispersing a core monomer resin(s), colorant, optionally a charge control agent, and a shell forming monomer, such as a diisocyanate, in an aqueous media containing a surfactant and alkali surfactant, adding a second stabilizing surfactant followed by the addition of the second shell forming monomer such as a diamine effecting the condensation polyurethane shell, and finally heating the mixture to effect the core forming resin by free radical polymerization.

These and other objects of the present invention can be accomplished in embodiments by the provision of encapsulated toners and process thereof. In one embodiment of the present invention, there are provided processes for the preparation of encapsulated toners with a core comprised of a polymer resin, colorants, such as pigment or dye, and thereover a shell comprised of a polyurea, polyurethane, or polyester. The aforementioned polyurethane shell is believed to yield toners with low minimum fixing temperatures of from about 100° to about 120° C., especially when reprographic technologies employing VITON® fusers are utilized. Specifically, in one embodiment there is provided in accordance with the present invention a process which utilizes a second surfactant that stabilizes the microdroplet size during the heat-fusible polyurethane shell forming step, yielding an encapsulated toner with an average particle size of from about 0.5 micron to about 7 microns and preferably from about 3 microns to about 7 microns as measured by the Coulter Counter.

In embodiments, the present invention relates to a process for the preparation of encapsulated toner compositions which comprises dispersing a mixture of addition monomers, an optional preformed polymer resin, a free radical initiator, a colorant comprised of a color pigment, dye or mixtures thereof, and shell forming monomer in an aqueous medium containing a cellulose polymer and a first ionic surfactant thereby forming a stable microdroplet suspension; and subsequently adding an aqueous solution of a second stabilizing surfactant followed by the formation of a soluble monomer forming shell wall by interfacial polymerization, and thereafter initiating and completing the core resin-forming free radical polymerization by heating thereby resulting in toner compositions with an average volume particle size of from about 3 to about 7 microns.

The toner compositions of the present invention can be prepared in embodiments by a simple one-pot process involving formation of stabilized particle suspension, followed by a surfactant stabilizing step and an interfacial shell polymerization, followed by a core resin forming free radical polymerization within the particles. The process comprises (1) thoroughly mixing or blending a mixture of core resin monomers, optional preformed core resins, free radical initiators, colorants, and a shell forming monomer such as a diisocyanate (dodecane diisocyanate); (2) dispersing the aforementioned well blended mixture by high shear blending to form stabilized microdroplets of specific droplet size and size distribution in an aqueous medium containing a suitable cellulose polymer, such as TYLOSE ®, and an optional ionic or inorganic surfactant such as sodium dodecylsulfate to control the desired particle size, and wherein the volume average microdroplet diameter can be desirably adjusted to be from about 2 microns to about 7 microns with the volume average droplet size dispersity being less than 1.35; (3) adding a second surfactant such as polyvinyl alcohol which provides particle stability; (4) adding a second shell monomer such as a diamine (JEFFAMINE D-400 TM) which condenses with the diisocyanate shell forming monomer via an interfacial polymerization mechanism and resulting in a polyurethane shell material; (5) effecting the free radical polymerization to form the core resin by heating; and (6) processing the resulting particles by washing, drying and thereafter optionally treating the toner product by the blending thereof with known surface additives. The formation of stabilized particle suspension is generally conducted at ambient, about 25° C. in embodiments, temperature, while the free radical polymerization can be accomplished at a temperature of from about 35° C. to about 120° C., and preferably from about 45° C. to about 90° C., for a period of time of from about 1 to about 24 hours depending primarily on the monomers and free radical initiators used. The core resin obtained via free radical polymerization, together with the optional preformed polymer resin, comprises from about 60 to about 95 percent, and preferably in an amount of from about 75 to about 95 percent by weight of toner, the colorant or pigment comprises from about 1 to about 15 percent by weight of toner, the shell material comprises from about 5 to about 30 percent by weight and more preferably from about 10 to about 20 percent by weight, while the surface additives comprised of flow aids, surface release agents, and charge control components comprise from about 0.1 to about 5 percent of toner in embodiments thereof.

The volume average particle size of the colored encapsulated toners of the present invention in embodiments can be controlled by appropriately adjusting the concentration of the cellulose material and ionic or inorganic surfactant. For example, in an embodiment, the colored encapsulated toner process of the present invention can be controlled such that the volume average particle size is 7 microns in diameter by adjusting the cellulose material, such as TYLOSE ®, or other equivalent material of from about 0.75 to about 1 percent by weight of water, and utilizing an ionic surfactant such as sodium dodecylsulfate of from about 0.0001 to 0.005 percent by weight of water. In another embodiment, the volume average particle size of the colored encapsulated toner can be controlled to about 5 microns in diameter by adjusting the cellulose material, such as TYLOSE ®, a methyl ethyl hydroxy cellulose, for from about 0.75 to about 1 percent by weight of water, and the ionic surfactant, such as sodium dodecylsulfate, to from about 0.01 to 0.02 percent by weight of water. In yet another embodiment, the volume average particle size of the colored encapsulated toner can be controlled to about 3 microns in diameter by adjusting the cellulose material, such as TYLOSE ®, to from about 0.75 to about 1 percent by weight of water, and the ionic surfactant such as sodium dodecylsulfate to from about 0.02 to 0.04 percent by weight of water. Additionally, in another embodiment, the volume average particle size of the colored encapsulated toner can be controlled to about 0.5 micron in diameter by adjusting the cellulose material, such as TYLOSE ®, to from about 0.5 to about 1.25 percent by weight of water, and the ionic surfactant such as sodium dodecylsulfate to from about 0.1 to 0.5 percent by weight of water. Generally, higher concentration of outer coating material and ionic or inorganic surfactant tend to decrease the average particle size diameter of the colored encapsulated toner.

In an embodiment, the colored encapsulated toner composition can be prepared by (i) mixing a core resin forming monomer, such as styrene, from about 0.6 mole to 0.8 mole, n-butyl methacrylate about 0.06 mole to about 0.08 mole, a colorant, such as HELIOGEN BLUE TM, from about 0.01 mole to about 0.015 mole, a shell forming diisocyanate monomer, such as dodecane diisocyanate, of from about 0.03 mole to about 0.05 mole and free radical initiators, such as VAZO 67 TM, from about 0.001 mole to about 0.003 mole; (ii) dispersing this mixture using a high shearing device, such as a Brinkman 45G probe, at from about 8,000 to about 10,000 rpm for a duration of from about 30 to about 120 seconds, in a vessel containing from about a 0.5 liter to about 0.75 liter of water having dissolved therein a cellulose surfactant, such as TYLOSE ®, of from about 0.75 to about 1 percent by weight of water, and an ionic surfactant, such as sodium dodecylsulfate, of from about 0 to 0.04 percent by weight of water; (iii) adding a second surfactant, such as polyvinyl alcohol, of from about 0.1 mole to about 0.5 mole percent by weight of water to stabilize the microdroplet; (iv) adding the second shell diamine monomer, such as JEFFAMINE D-400 TM, and heating to cause polymerization and shell formation of from about 0.03 mole to about 0.05 mole; and (v) heating the mixture to effect free radical core polymer formation, from about 60° C. to about 95° C., for an effective period of time of, for example, from about 360 minutes to about 720 minutes. The toner product is then washed by centrifugation from about 4 to about six times, and dried using preferably a fluidized bed operated at from about 30° C. to about 60° C. for a duration of from about 240 minutes to about 480 minutes. Flow additives to improve flow characteristics may then optionally be employed, such as AEROSIL R-200 ® and the like, of from about 0.1 to about 10 percent by weight of toner.

Illustrative examples of core monomers, which are subsequently polymerized, include a number of known components such as acrylates, methacrylates, olefins including styrene and its derivatives such as methyl styrene, and the like. Specific examples of core monomers include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and known addition monomers, reference for example U.S. Pat. No. 4,298,672, the disclosure of which is totally incorporated herein by reference, and mixtures thereof. Illustrative examples of optional preformed core resins include styrene polymers, such as styrene-butadiene copolymers, PLIOLITES ®, available from Goodyear Chemical, PLIOTONES ®, available from Goodyear Chemical, polyesters, acrylate and methacrylate polymers, and the like.

Various known colorants or pigments may be selected for the toner compositions of the present invention providing, for example, that they do not substantially interfere with the free radical polymerization. Typical examples of colorants, preferably present in an effective amount of, for example, from about 3 to about 10 weight percent of the toner include cyan, magenta, yellow, red, green, blue, brown, and mixtures thereof, and more specifically, PALIOGEN VIOLET 5100 TM and 5890 TM (BASF), NORMANDY MAGENTA RD-2400 TM (Paul Uhlich), PERMANENT VIOLET VT2645 TM (Paul Uhlich), HELIOGEN GREEN L8730 TM (BASF), ARGYLE GREEN XP-111-S TM (Paul Uhlich), BRILLIANT GREEN TONER GR 0991 TM (Paul Uhlich), LITHOL SCARLET D3700 TM (BASF), TOLUIDINE RED TM (Aldrich), Scarlet for Thermoplast NSD Red (Aldrich), LITHOL RUBINE TONER TM (Paul Uhlich), LITHOL SCARLET 4440 TM, NBD 3700 TM (BASF), BON RED C TM (Dominion Color), ROYAL BRILLIANT RED RD-8192 TM (Paul Uhlich), ORACET PINK RF TM (Ciba Geigy), PALIOGEN RED 3340 TM and 3871K TM (BASF), LITHOL FAST SCARLET L4300 TM (BASF), HELIOGEN BLUE D6840 TM, K7080 TM, K7090 TM, K6902 TM, K6910 TM and L7020 TM (BASF), SUDAN BLUE OS TM (BASF), NEOPEN BLUE FF4012 TM (BASF), PV FAST BLUE B2G01 TM (American Hoechst), IRGALITE BLUE BCA TM (Ciba Geigy), PALIOGEN BLUE 6470 TM (BASF), SUDAN II TM, III TM and IV TM (Matheson, Coleman, Bell), SUDAN ORANGE TM (Aldrich), SUDAN ORANGE 220 TM (BASF), PALIOGEN ORANGE 3040 TM (BASF), ORTHO ORANGE OR 2673 TM (Paul Uhlich), PALIOGEN YELLOW 152 TM and 1560 TM (BASF), LITHOL FAST YELLOW 0991K TM (BASF), PALIOTOL YELLOW 1840 TM (BASF), NOVAPERM YELLOW FGL TM (Hoechst), PERMANENT YELLOW YE 0305 TM (Paul Uhlich), LUMOGEN YELLOW D0790 TM (BASF), SUCO-GELB L1250 TM (BASF), SUCO-YELLOW D1355 TM (BASF), SICO FAST YELLOW D1165 TM, D1355 TM and D1351 TM (BASF), HOSTAPERM PINK E TM (Hoechst), FANAL PINK D4830 TM (BASF), CINQUASIA MAGENTA TM (DuPont), PALIOGEN BLACK L0084 TM (BASF), PIGMENT BLACK k801 TM (BASF), carbon blacks such as REGAL 330 ® (Cabot), Carbon Black 5250, and 5750 (Columbian Chemicals), and the like.

Examples of the first surfactant polymers selected for the toners and processes of the present invention include alkyl celluloses with the alkyl groups containing, for example, from 1 to about 10 carbon atoms; and more specifically methyl cellulose, ethyl cellulose, hydroxyethyl cellulose, hydroxypropyl cellulose, hydroxyethylmethyl cellulose, TYLOSE ® and the like. The effective concentration of the cellulose polymer in the aqueous phase at the dispersion or microdroplet formation step is, for example, from about 0.1 percent by weight to about 5 percent by weight with the preferred amount being determined primarily by the nature of the toner precursor materials and the desired toner particle size. In embodiments, inorganic surfactants can also be utilized in admixture with the cellulose polymer for achieving a smaller microdroplet size. Illustrative examples of suitable inorganic surfactants include alkali metal salts, such potassium oleate, potassium caprate, potassium stearate, sodium laurate, sodium dodecyl sulfate, sodium oleate, sodium laurate, and the like. The effective concentration of inorganic surfactant that is generally employed is, for example, from about 0.005 to about 0.5 percent by weight, and preferably from about 0.01 to about 0.10 percent by weight. There can be added to the toner known surface additives, such as silicas like AEROSIL R972 ®, metal oxides, such as tin oxide, in effective amounts, such as about 0.5 to about 1 weight percent, and mixtures thereof.

Examples of second surfactants present in effective amounts of, for example, from about 0.1 weight percent to about 3 weight percent, and utilized as a stabilizer for preventing toner aggregation or coalescence during shell forming step include polyvinyl alcohol, polyvinyl acetate, sulfonated polynaphthalene hydroxy cellulose, polyacrylic acid, polymethacrylic acid, and mixture thereof.

Examples of shell polymers include polyureas, polyamides, polyesters, polyurethanes, mixtures thereof, and the like, and which shells may contain within their structures certain soft, flexible moieties such as polyether functions which, for example, assist in the molecular packing of the shell materials as well as imparting the desirable low surface energy characteristics to the shell structure, and additionally provide low softening points. The shell amounts are generally from about 5 to about 30 percent by weight of the toner, and have a thickness generally, for example, of less than about 5 microns as indicated herein. In one embodiment of the present invention, the shells are formed by known interfacial polycondensation of one or more diisocyanates with one or more diamines. Examples of diisocyanates include Uniroyal Chemical's diphenylmethane diisocyanate-based liquid polyether VIBRATHANES TM such as B-635, B-843, and the like, toluene diisocyanate-based liquid polyether VIBRATHANES TM such as B-604, B-614, and the like, and Mobay Chemical Corporation's liquid polyether isocyanate prepolymers E-21 or E-21A (product code number D-716), 743 (product code numbers D-301), 744 (product code number D-302), and the like. Other diisocyanates that can be selected for the formation of shell material are those available commercially including, for example, benzene diisocyanate, toluene diisocyanate, diphenylmethane diisocyanate, 1,6-hexamethylene diisocyanate, DESMODUR W TM, bis(4-isocyanatocyclohexyl)-methane, MONDUR CB-60 TM, MONDUR CB-75 TM, MONDUR MR TM, MONDUR MRS 10 TM, PAPI 27 TM, PAPI 135 TM, ISONATE 143L TM, ISONATE 181 TM, ISONATE 125M TM, ISONATE 191 TM, and ISONATE 240 TM, and dodecane diisocyanate. Illustrative examples of diamines suitable for the interfacial polycondensation shell formation include, for example, ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, 1,4-bis(3-aminopropyl)-piperazine, and 2,5-dimethylpentamethylene diamine (DYTEK A TM), JEFFAMINE D-400 TM, D-700 TM, D-740 TM, D-1100 TM, D-6000 TM, amino terminated propylene glycol, for example D-400 TM, has weight average molecular weight of 400, mixtures thereof and the like. Generally, the shell polymer comprises from about 5 to about 30 percent by weight of the total toner composition, and preferably comprises from about 10 percent by weight to about 20 percent by weight of the toner composition. During the aforementioned interfacial polycondensation to form the shell, the temperature is maintained at from about 15° C. to about 55° C., and preferably from about 20° C. to about 30° C. Also, generally the reaction time is from about 5 minutes to about 5 hours, and preferably from about 20 minutes to about 90 minutes. Other temperatures and times can be selected, and further polyisocyanates and polyamines not specifically illustrated may be selected.

Illustrative examples of known free radical initiators that can be selected for the preparation of the toners of the present invention include azo-type initiators such as 2-2'-azobis(dimethylvaleronitrile), azobis(isobutyronitrile), VAZO 64 TM, azobis(cyclohexanenitrile), azobis(methylbutyronitrile), mixtures thereof, and the like, peroxide initiators such as benzoyl peroxide, lauroyl peroxide, methyl ethyl ketone peroxide, isopropyl peroxycarbonate, 2,5-dimethyl-2,5-bis(2-ethylhexanoylperoxy)hexane, di-tert-butyl peroxide, cumene hydroperoxide, dichlorobenzoyl peroxide, and mixtures thereof with the effective quantity of initiator being, for example, from about 0.1 percent to about 10 percent by weight of that of core monomer.

For two component developers, carrier particles including steel ferrites, especially copper zinc ferrites, and the like, with or without coatings, can be admixed, from about 1 to about 3 parts of toner for each 100 parts of carrier for example, with the encapsulated toners of the present invention, reference for example the carriers illustrated in U.S. Pat. Nos. 4,937,166; 4,935,326; 4,560,635; 4,298,672; 3,839,029; 3,847,604; 3,849,182; 3,914,181; 3,929,657 and 4,042,518, the disclosures of which are totally incorporated herein by reference.

Percent by weight as utilized herein, unless otherwise indicated, is based on the total toner components or reaction components selected.

The following Examples are being submitted to further define various species of the present invention. These Examples are intended to be illustrative only and are not intended to limit the scope of the present invention. Comparative Examples are also provided.

EXAMPLE I

The preparation of a 6.8 micron cyan colored encapsulated toner comprised of an isobutyl methacrylate core, HELIOGEN BLUE TM, a polyurethane shell, and utilizing a second stabilizing surfactant prior to shell formation follows.

A mixture of 214.0 grams of isobutyl methacrylate, dodecane diisocyanate (27.6 grams) and 8.0 grams of HELIOGEN BLUE K7090 TM (BASF) pigment was ball milled for 24 hours. To this mixture were added 6.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture was then transferred to a 2-liter reaction vessel containing 700 milliliters of a 1.0 percent aqueous TYLOSE ® solution and 0.005 percent of sodium dodecylsulfate, and the resulting mixture was homogenized for 2 minutes using a Brinkmann polytron operating at 10,000 rpm. Thereafter, a 3 percent aqueous solution of polyvinyl alcohol (150 grams) was added followed by a slow addition of JEFFAMINE D-400 TM (12.8 grams) and DYTEK A TM (2.6 grams) using a syringe pump over a 30 minute period. The mixture was then mechanically stirred at room temperature, 25° C., for 30 additional minutes and then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner particle comprised of a core comprised of about 77 weight percent of poly(isobutyl methacrylate), 3 weight percent of HELIOGEN BLUE TM, and 20 weight percent of a polyurethane shell, evidenced a volume average particle diameter of 6.8 microns, and a particle size distribution of 1.38 according to Coulter Counter measurements.

Fifty (50.0) grams of the above prepared dried toner particles were dry blended with a mixture of 0.75 gram of AEROSIL R812 ®, a colloidal silica, and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a copper zinc ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner, the images were transferred to a paper and transparency substrate and fixed with heat, and the minimum fixing temperature of this toner was found to be 105° C. Additionally, the projection efficiency of this toner was found to be 80 percent as measured by the Match Scan II spectrophotometer available from Milton Roy Corporation.

COMPARATIVE EXAMPLE I

The preparation of a cyan colored encapsulated toner composition comprised of an isobutyl methacrylate core, HELIOGEN BLUE TM and a polyurethane shell, and utilizing the process of U.S. Pat. No. 5,043,240 wherein no second stabilizing surfactant is utilized prior to shell formation follows.

A mixture of 214.0 grams of isobutyl methacrylate, dodecane diisocyanate (27.6 grams) and 8.0 grams of HELIOGEN BLUE K7090 TM (BASF) pigment was ball milled for 24 hours. To this mixture were added 6.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2-liter reaction vessel containing 700 milliliters of a 1.0 percent aqueous TYLOSE ® solution and 0.005 percent of sodium dodecylsulfate, and the resulting mixture was homogenized for 2 minutes using a Brinkmann polytron operating at 10,000 rpm, followed by the slow addition of JEFFAMINE D-400 TM, weight average molecular weight of 400, (12.8 grams) and DYTEK A TM (2.6 grams) using a syringe pump over a 30 minute period. The resulting mixture was then mechanically stirred at room temperature, 25° C., for 30 additional minutes and then heated to 80° C. over a period of 1 hour, and maintained at this temperature for another 10 hours. After cooling down to room temperature, about 25° C., the reaction product was washed repeatedly with water until the aqueous phase was clear, and the product was then freeze dried for 24 hours. The resulting toner particle product evidences aggregation of particles, and subsequently sieved using a 63 micron screen to yield 35 grams of unaggregated toner particles. The resulting toner particle product comprised of a core comprised of about 77 weight percent of poly(isobutyl methacrylate), 3 weight percent of HELIOGEN BLUE TM, and 20 weight percent of a polyurethane shell evidenced a volume average particle diameter of 18 microns, and a particle size distribution of 1.6 according to Coulter Counter measurements.

Thus, when utilizing a process of U.S. Pat. No. 5,043,240 for the preparation of encapsulated toner with heat-fusible polyurethane shell, a relatively large particle size of about 18 microns and broad particle size distribution of 1.6 were obtained in this comparative Example I. In contrast, a relatively small particle size of about 6.8 microns and particle size distribution of 1.38 were obtained using the process of an embodiment of this invention as described in Example I.

EXAMPLE II

The preparation of a 5.2 micron cyan colored encapsulated toner composition comprised of an isobutyl methacrylate core, HELIOGEN BLUE TM and a polyurethane shell follows.

A mixture of 107.0 grams of isobutyl methacrylate, dodecane diisocyanate (13.8 grams) and 4.0 grams of HELIOGEN BLUE K7090 TM (BASF) pigment was ball milled for 24 hours. To this mixture were added 6.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2-liter reaction vessel containing 700 milliliters of a 1.0 percent aqueous TYLOSE ® solution and 0.01 percent of sodium dodecylsulfate, and the resulting mixture was homogenized for 2 minutes using a Brinkmann polytron operating at 10,000 rpm. Thereafter, a 3 percent aqueous solution of polyvinyl alcohol (150 grams) was added followed by a slow addition of JEFFAMINE D-400 TM (12.8 grams) and DYTEK A TM (2.6 grams) using a syringe pump over a 30 minute period. The mixture was then mechanically stirred at room temperature, 25° C., for 30 additional minutes and then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner comprised of a core comprised of about 77 weight percent of poly(isobutyl methacrylate), 3 weight percent of HELIOGEN BLUE TM, and 20 weight percent of a polyurethane shell, evidenced a volume average particle diameter of 5.2 microns, and a particle size distribution of 1.4 according to Coulter Counter measurements.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a copper, zinc ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner, the images were transferred to paper and transparency substrate and fixed with heat, and the minimum fixing temperature of this toner was found to be 100° C. Additionally, the projection efficiency of this toner was found to be 84 percent as measured by the Match Scan II spectrophotometer available from Milton Roy Corporation.

COMPARATIVE EXAMPLE II

The preparation of a cyan colored encapsulated toner composition comprised of an isobutyl methacrylate core, HELIOGEN BLUE TM and a pressure rupturable polyurethane shell as described in U.S. Pat. No. 5,043,240, and utilizing the process of U.S. Pat. No. 5,043,240, the disclosure of which is totally incorporated herein by reference, follows.

A mixture of 214.0 grams of isobutyl methacrylate, ISONATE 143-L TM (25.6 grams), DESMODUR W TM, methyl diphenyl diisocyanato terminated ethylene glycol, (2.0 grams) and 8.0 grams of HELIOGEN BLUE K7090 TM (BASF) pigment was ball milled for 24 hours. To this mixture were added 6.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2 liter reaction vessel containing 700 milliliters of a 1.0 percent aqueous TYLOSE ® solution and 0.005 percent of sodium dodecylsulfate, and the resulting mixture was homogenized for 2 minutes using a Brinkmann polytron operating at 10,000 rpm. Thereafter, bis-(3-aminopropyl)-piperazine (15.2 grams) was added. The mixture was then mechanically stirred at room temperature, 25° C., for 30 additional minutes and then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner comprised of a core comprised of about 77 weight percent of poly(isobutyl methacrylate), 3 weight percent of HELIOGEN BLUE TM, and 20 weight percent of a polyurethane shell evidenced a volume average particle diameter of 18 microns, and a particle size distribution of 1.58 according to Coulter Counter measurements.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core with major amounts of copper and zinc coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner, the images were transferred to paper and transparency substrate and fixed with heat, and the minimum fixing temperature of this toner was found to be 160° C. Additionally, the projection efficiency of this toner was found to be 56 percent as measured by the Match Scan II spectrophotometer available from Milton Roy Corporation.

When utilizing a process of U.S. Pat. No. 5,043,240 for the preparation of encapsulated toner with pressure rupturable polyurethane shell, a relatively large particle size of about 18 microns and broad particle size distribution of 1.58 were obtained in this Comparative Example II. In contrast, a relatively small particle size of about 5.2 microns and particle size distribution of 1.4 were obtained using the process of this invention as described in Example II.

EXAMPLE III

The preparation of a 6.1 micron cyan colored encapsulated toner composition comprised of an isobutyl methacrylate core, HELIOGEN BLUE TM and a polyurethane shell follows.

A mixture of 214.0 grams of isobutyl methacrylate, dodecane diisocyanate (27.6 grams) and 8.0 grams of HELIOGEN BLUE K7090 TM (BASF) pigment was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2 liter reaction vessel containing 700 milliliters of a 1.0 percent aqueous TYLOSE ® solution and 0.0075 percent of sodium dodecylsulfate, and the resulting mixture was homogenized for 2 minutes using a Brinkmann polytron operating at 10,000 rpm. Thereafter, a 3 percent aqueous solution of polyvinyl alcohol (150 grams) was added followed by a slow addition of JEFFAMINE D-400 TM (12.8 grams) and DYTEK A TM (2.6 grams) using a syringe pump over a 30 minute period. The mixture was then mechanically stirred at room temperature, 25° C., for 30 additional minutes and then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner product comprised of a core comprised of about 77 weight percent of poly(isobutyl methacrylate), 3 weight percent of HELIOGEN BLUE TM, and 20 weight percent of a polyurethane shell evidenced a volume average particle diameter of 6.1 microns, and a particle size distribution of 1.36 according to Coulter Counter measurements.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core containing major amounts of copper and zinc coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner, the images were transferred to paper and transparency substrate and fixed with heat, and the minimum fixing temperature of this toner was found to be 100° C. Additionally, the projection efficiency of this toner was found to be 76 percent as measured by the Match Scan II spectrophotometer available from Milton Roy Corporation.

EXAMPLE IV

The preparation of a 5.0 micron cyan colored encapsulated toner composition comprised of a styrene-butyl methacrylate core, HELIOGEN BLUE TM and a polyurethane shell follows.

A mixture of 134.0 grams of isobutyl methacrylate, 80 grams of styrene, dodecane diisocyanate (27.6 grams) and 8.0 grams of HELIOGEN BLUE K7090 TM (BASF) pigment was ball milled for 24 hours. To this mixture were added 6.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture was then transferred to a 2 liter reaction vessel containing 700 milliliters of a 1.0 percent aqueous TYLOSE ®, a methyl ethyl hydroxy cellulose, solution and 0.005 percent of sodium dodecylsulfate, and the resulting mixture was homogenized for 2 minutes using a Brinkmann polytron operating at 10,000 rpm. Thereafter, a 3 percent aqueous solution of polyvinyl alcohol (150 grams) were added followed by a slow addition of JEFFAMINE D-400 TM, an amino terminated propylene glycol, (12.8 grams) and DYTEK A TM (2.6 grams) using a syringe pump over a 30 minute period. The mixture was then mechanically stirred at room temperature, 25° C., for 30 additional minutes and then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner product comprised of a core comprised of about 77 weight percent of poly(isobutyl methacrylate), 3 weight percent of HELIOGEN BLUE TM, and 20 weight percent of a polyurethane shell evidenced a volume average particle diameter of 5.0 microns, and a particle size distribution of 1.33 according to Coulter Counter measurements.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner, the images were transferred to paper and transparency substrate and fixed with heat, and the minimum fixing temperature of this toner was found to be 110° C. The toner image thereafter was measured using a GARDNER TM gloss unit and displayed a gloss value of 76 gloss units. Additionally, the projection efficiency of this toner was found to be 75 percent as measured by the Match Scan II spectrophotometer available from Milton Roy Corporation.

EXAMPLE V

The preparation of a 5.3 micron cyan colored encapsulated toner composition comprised of a styrene-butyl methacrylate-n-lauryl methacrylate core, HELIOGEN BLUE TM and a polyurethane shell follows.

A mixture of 142 grams of isobutyl methacrylate, 35.6 grams of n-lauryl methacrylate, 39 grams of styrene, dodecane diisocyanate (27.6 grams) and 8.0 grams of HELIOGEN BLUE K7090 TM (BASF) pigment was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2 liter reaction vessel containing 700 milliliters of a 1.0 percent aqueous TYLOSE ® solution and 0.01 percent of sodium dodecylsulfate, and the resulting mixture was homogenized for 2 minutes using a Brinkmann polytron operating at 10,000 rpm. Thereafter, a 3 percent aqueous solution of polyvinyl alcohol (150 grams) was added followed by a slow addition of JEFFAMINE D-400 TM (12.8 grams) and DYTEK A TM (2.6 grams) using a syringe pump over a 30 minute period. The mixture was then mechanically stirred at room temperature, 25° C., for 30 additional minutes and then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner product comprised of a core comprised of about 77 weight percent of poly(isobutyl methacrylate), 3 weight percent of HELIOGEN BLUE TM, and 20 weight percent of a polyurethane shell evidenced a volume average particle diameter of 5.3 microns, and a particle size distribution of 1.34 according to Coulter Counter measurements.

Fifty (50.0) grams of the above prepared dried toner particles were dry blended with a mixture of 0.75 gram of AEROSIL R812 ® and 0.80 grams of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core with major amounts of copper and zinc coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner the images were transferred to paper and transparency substrate and fixed with heat, and the minimum fixing temperature of this toner was found to be 112° C. Additionally, the projection efficiency of this toner was found to be 78 percent as measured by the Match Scan II spectrophotometer available from Milton Roy Corporation.

EXAMPLE VI

The preparation of a 4.8 micron cyan colored encapsulated toner composition comprised of a styrene-butyl acrylate core, HELIOGEN BLUE TM and a polyurethane shell follows.

A mixture of 38 grams of butyl acrylate, 176 grams of styrene, dodecane diisocyanate (27.6 grams) and 8.0 grams of HELIOGEN BLUE K7090 TM (BASF) pigment was ball milled for 24 hours. To this mixture were added 6.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture was then transferred to a 2 liter reaction vessel containing 700 milliliters of a 1.0 percent aqueous TYLOSE ® solution and 0.01 percent of sodium dodecylsulfate, and the resulting mixture was homogenized for 2 minutes using a Brinkmann polytron operating at 10,000 rpm. Thereafter, a 3 percent aqueous solution of polyvinyl alcohol (150 grams) was added followed by a slow addition of JEFFAMINE D-400 TM (12.8 grams) and DYTEK A TM (2.6 grams) using a syringe pump over a 30 minute period. The mixture was then mechanically stirred at room temperature, 25° C., for 30 additional minutes and then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner product comprised of a core comprised of about 77 weight percent of poly(isobutyl methacrylate), 3 weight percent of HELIOGEN BLUE TM, and 20 weight percent of a polyurethane shell evidenced a volume average particle diameter of 4.8 microns, and a particle size distribution of 1.36 according to Coulter Counter measurements.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner, the images were transferred to paper and transparency substrate and fixed with heat, and the minimum fixing temperature of this toner was found to be 115° C. Additionally, the projection efficiency of this toner was found to be 81 percent as measured by the Match Scan II spectrophotometer available from Milton Roy Corporation.

EXAMPLE VII

The preparation of a 3.3 micron magenta colored encapsulated toner composition comprised of a styrene-butadiene core, HELIOGEN BLUE TM and a polyurethane shell follows.

A mixture of 180.0 grams of styrene, dodecane diisocyanate (27.6 grams) and 8.0 grams of HOSTAPERM PINK TM pigment was ball milled for 24 hours. To this mixture were added 3.0 grams each of two free radical initiators, 2,2'-azobis-(2,4-dimethylvaleronitrile) and 2,2'-azobis-(isobutyronitrile), and the mixture was roll blended until all the free radical initiators were dissolved. One hundred and fifty (150) grams of the resulting mixture were then transferred to a 2 liter part reaction vessel containing 700 milliliters of a 1.0 percent aqueous TYLOSE ® solution and 0.02 percent of sodium dodecylsulfate, and the resulting mixture was homogenized for 2 minutes using a Brinkmann polytron operating at 10,000 rpm. Thereafter, butadiene (17 grams) was introduced at −5° C. and reactor was then sealed and pressurized soon after to 350 pounds per square inch. A 3 percent aqueous solution of polyvinyl alcohol (150 grams) was added followed by a slow addition of JEFFAMINE D-400 TM (12.8 grams) and DYTEK A TM (2.6 grams) using a syringe pump over a 30 minute period. The mixture was then mechanically stirred at room temperature, 25° C., for 30 additional minutes and then heated to 80° C. over a period of 1 hour, and maintained at this temperature for another 10 hours. After cooling down to room temperature, the reaction product was washed repeatedly with water until the aqueous phase was clear, and the product was then freeze dried for 24 hours. The resulting toner product comprised of a core comprised of about 77 weight percent of poly(isobutyl methacrylate), 3 weight percent of HOSTAPERM PINK TM, and 20 weight percent of a polyurethane shell evidenced a volume average particle diameter of 3.3 microns, and a particle size distribution of 1.41 according to Coulter Counter measurements.

Fifty (50.0) grams of the above prepared dried toner particles were dry blended with a mixture of 0.75 gram of AEROSIL R812 ® and 0.80 gram of conductive tin oxide powder for 10 minutes using a Grey blender with its blending impeller operating at 2,500 rpm. A negatively charged developer was prepared by blending 2 parts by weight of the above toner particles with 98 parts by weight of carrier particles comprised of a ferrite core coated with a terpolymer of methyl methacrylate, styrene, and vinyl triethoxysilane polymer, 0.7 weight percent of coating, reference U.S. Pat. Nos. 3,467,634 and 3,526,533, the disclosures of which are totally incorporated herein by reference. The toner latent images were then formed in a xerographic experimental imaging device similar to the Xerox Corporation 9200, and subsequent to the development of images with the aforementioned prepared toner, the images were transferred to paper and transparency substrate and fixed with heat, and the minimum fixing temperature of this toner was found to be 120° C. Additionally, the projection efficiency of this toner was found to be 70 percent as measured by the Match Scan II spectrophotometer available from Milton Roy Corporation.

The ferrite core selected for the working Examples was comprised of major amounts of copper and zinc, and can be obtained, for example, from Steward Chemicals.

Other modifications of the present invention may occur to those skilled in the art subsequent to a review of the present application, and these modifications, including equivalents thereof, are intended to be included within the scope of the present invention.

What is claimed is:

1. A process for the preparation of encapsulated toner compositions consisting essentially of dispersing a mixture of addition monomers, an optional preformed polymer resin, a free radical initiator, a colorant comprised of a pigment, dye or mixtures thereof, and shell forming monomer in an aqueous medium containing a cellulose polymer and a first ionic surfactant thereby forming a stable microdroplet suspension; and subsequently adding an aqueous solution of a second stabilizing surfactant selected from the group consisting of polyvinyl alcohol, polyvinyl acetate, sulfonated polynaphthalene hydroxy cellulose, polyacrylic acid, polymethacrylic acid, and mixtures thereof; followed by the formation of a soluble monomer forming shell wall by interfacial polymerization, and thereafter initiating and completing the core resin-forming free radical polymerization by heating thereby resulting in toner compositions with an average volume particle size of from about 0.5 to about 7 microns, and a particle size distribution of less than about 1.40; and wherein the concentration of the ionic surfactant is from about 0 to about 0.5 percent by weight of water.

2. A process in accordance with claim 1 wherein the dispersion is accomplished at a temperature of from about 25° C. to about 35° C.

3. A process in accordance with claim 1 wherein the free radical polymerization is accomplished at a temperature of from about 35° C. to about 120° C., and the interfacial polymerization is accomplished at a temperature of from about 20° C. to about 35° C.

4. A process in accordance with claim 1 wherein the colorant is cyan, magenta, yellow, or mixtures thereof.

5. A process in accordance with claim 1 wherein the shell interfacial polymerization results in a polyurethane, a polyester, a polyamide, a polyether or a polyurea.

6. A process in accordance with claim 1 wherein the projection efficiency of the encapsulated toner is from about 60 percent to about 100 percent transmittance.

7. A process in accordance with claim 1 wherein the cellulose polymer is selected from the group consisting of methylethyl cellulose, hydroxyethylmethyl cellulose, hydroxypropylmethyl cellulose, hydroxy methyl cellulose and mixtures thereof.

8. A process in accordance with claim 1 wherein the ionic surfactant is an inorganic surfactant selected from the group consisting of potasium oleate, potassium caprate, potassium stearate, sodium laurate, sodium dodecylsulfate, sodium oleate, sodium laurate, sodium dodecylbenzyl sulfonate, dialkylbenzyl ammonium chloride, and mixtures thereof; and wherein said inorganic surfactant is selected in an amount of from about 0.005 to about 0.5 percent by weight.

9. A process in accordance with claim 1 wherein the second stabilizing surfactant is present in an amount of from about 0.1 weight percent to about 3 weight percent.

10. A process in accordance with claim 1 wherein the colorant is a cyan blue pigment and there results a toner with an average volume particle size of about 5 microns and a particle size distribution of 1.4.

11. A process in accordance with claim 1 wherein the average volume particle diameter of the encapsulated toner is from about 3 microns to about 7 microns.

12. A process in accordance with claim 1 wherein the average particle volume diameter size of the microcapsule is controlled by adjusting the concentration of the cellulose to form about 0.75 percent to about 1.25 percent.

13. A process in accordance with claim 1 wherein the volume average particle size of the toner is about 7 microns by adjusting the concentration of the cellulose polymer to from about 0.75 percent to about 1.25 percent by weight of water, and adjusting the concentration of ionic surfactant comprised of sodium dodecylsulfate to about 0.005 percent by weight of the aqueous medium.

14. A process in accordance with claim 1 wherein the volume average particle size of the toner is about 5 microns by adjusting the concentration of the cellulose polymer to from about 0.75 percent to about 1.25 percent by weight of water, and adjusting the concentration of the ionic surfactant comprised of sodium dodecylsulfate to from about 0.01 to about 0.02 percent by weight of the aqueous medium.

15. A process in accordance with claim 14 wherein the volume average particle size of the toner is controlled to about 3 microns by adjusting the concentration of the cellulose polymer comprised of methyl cellulose to from about 0.75 percent to about 1.25 percent by weight of water, and adjusting the concentration of the ionic surfactant of sodium dodecylsulfate to from about 0.02 to about 0.04 percent by weight of the aqueous medium.

16. A process in accordance with claim 1 wherein the shell is a polyurethane and is formed by an interfacial polymerization reaction between an oil soluble diisocyanate monomer and an aqueous soluble diamine monomer.

17. A process in accordance with claim 16 wherein the oil soluble diisocyanate monomer is selected from the group consisting of dodecane diisocyanate, trimethylhexamethylene diisocyanate, methylpentamethylene diisocyanate, 1,3-bis(cyclohexyl)methane diisocyanate, and mixtures thereof.

18. A process in accordance with claim 16 wherein the aqueous soluble diamine monomer is selected from the group consisting of methylpentamethylene diamine, dodecane diamine, cyclohexyl diamine, propyl diamine, ethyl diamine, butyl diamine, dimethyl piperazine, and mixtures thereof.

19. A process in accordance with claim 1 wherein the free radical core forming monomer is selected from the group consisting of methyl methacrylate, ethyl methacrylate, propyl methacrylate, butyl methacrylate, pentyl methacrylate, hexyl methacrylate, 2-ethyl hexyl methacrylate, dodecyl methacrylate, decyl methacrylate, nonyl methacrylate, lauryl methacrylate, stearyl methacrylate, styrene, isobutyl methacrylate, n-butyl methacrylate, butyl acrylate, and mixtures thereof.

20. A process in accordance with claim 1 wherein the polyurethane shell material has a softening point of from about 80° C. to about 120° C.

21. A process in accordance with claim 1 wherein the cellulose polymer is selected from the group consisting of methylethyl cellulose, hydroxyethylmethyl cellulose, hydroxypropylmethyl cellulose, hydroxymethyl cellulose and mixtures thereof, said first ionic surfactant is an inorganic surfactant selected from the group consisting of potassium oleate, potassium caprate, potassium stearate, sodium laurate, sodium dodecylsulfate, sodium oleate, sodium laurate, sodium dodecylbenzyl sulfonate, dialkylbenzyl ammonium chloride, and mixtures thereof resulting in toner compositions with an average volume particle size of from about 3 to about 7 microns; and wherein said cellulose polymer is selected in an amount of from about 0.1 to about 5 weight percent, said inorganic surfactants present in an amount of from about 0.01 to about 0.10 weight percent, and said second surfactant is present in an amount of from about 0.1 weight percent to about 3.0 weight percent.

22. A process in accordance with claim 1 wherein the colorant is a cyan pigment, the addition monomer is an isobutyl methacrylate, the shell is a polyurethane, the cellulose polymer is hydroxyethylmethyl cellulose, the ionic surfactant is sodium dodecyl sulfate, the second stabilizing surfactant is polyvinyl alcohol, and the toner composition resulting has an average particle size of about 7 to 8 microns and particle size distribution of about 1.4.

* * * * *